US009595791B2

(12) United States Patent
Takano

(10) Patent No.: US 9,595,791 B2
(45) Date of Patent: Mar. 14, 2017

(54) ELECTRIC WIRES WITH IDENTIFICATION INDICATORS

(71) Applicant: SUMITOMO WIRING SYSTEMS, LTD., Mie (JP)

(72) Inventor: Koki Takano, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 15/030,726

(22) PCT Filed: Oct. 17, 2014

(86) PCT No.: PCT/JP2014/077654
§ 371 (c)(1),
(2) Date: Apr. 20, 2016

(87) PCT Pub. No.: WO2015/064381
PCT Pub. Date: May 7, 2015

(65) Prior Publication Data

US 2016/0240974 A1 Aug. 18, 2016

(30) Foreign Application Priority Data

Nov. 1, 2013 (JP) ..... 2013-228185
Jan. 10, 2014 (JP) ..... 2014-002951

(51) Int. Cl.

| | |
|---|---|
| ***H01R 3/00*** | (2006.01) |
| ***H01R 13/64*** | (2006.01) |
| ***H01R 13/52*** | (2006.01) |
| *H01R 4/18* | (2006.01) |
| *H01R 107/00* | (2006.01) |

(52) U.S. Cl.
CPC ..... *H01R 13/64* (2013.01); *H01R 13/5205* (2013.01); *H01R 13/5208* (2013.01); *H01R 4/185* (2013.01); *H01R 2107/00* (2013.01)

(58) Field of Classification Search
CPC H01R 13/64; H01R 13/5208; H01R 13/5205; H01R 4/185; H01R 2107/00
See application file for complete search history.

(56) References Cited

U.S. PATENT DOCUMENTS 5,020,933 A * 6/1991 Salvestro ..... A61B 17/02 403/24
6,206,714 B1 * 3/2001 Bernardini ..... H01R 13/213 439/166

FOREIGN PATENT DOCUMENTS

| | | |
|---|---|---|
| JP | 63-017525 | 2/1988 |
| JP | 07-263074 | 10/1995 |
| JP | 4644977 | 12/2010 |

OTHER PUBLICATIONS

Search Report issued by PCT/JP2014/077654 patent office in PCT/JP2014/077654 Patent Application No. , dated Nov. 25, 2014.

* cited by examiner

*Primary Examiner* — Jean F Duverne
(74) *Attorney, Agent, or Firm* — Greenblum & Bernstein, P.L.C.

(57) ABSTRACT

Colors for electric wires are reduced. A plurality of electric wires to be connected to a single connector have a single color, rubber plugs are attached to boundary portions that are each located extending from a terminal for connection to a connector connected to an end of the electric wire to the insulating coating of the electric wire, and the rubber plugs have different colors for identification.

5 Claims, 4 Drawing Sheets

FIG. 1 ( A )
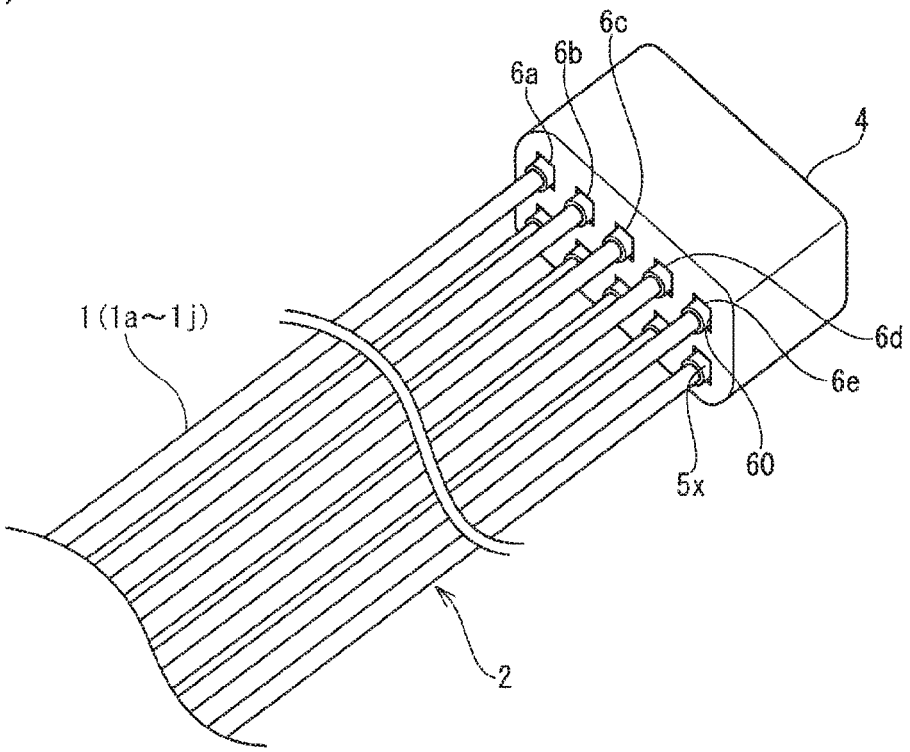
FIG. 1 ( B )
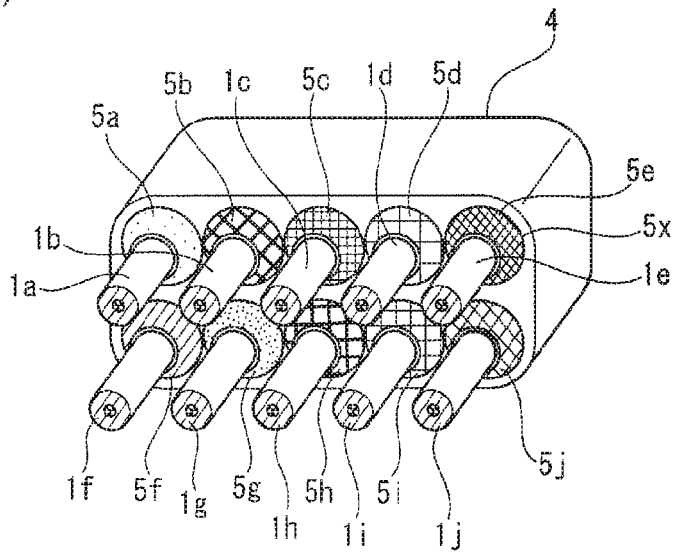

FIG. 2 ( A )
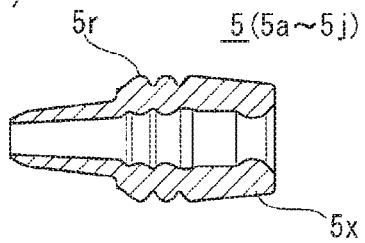
FIG. 2 ( B )
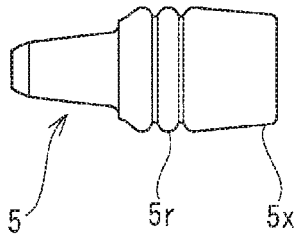
FIG. 3
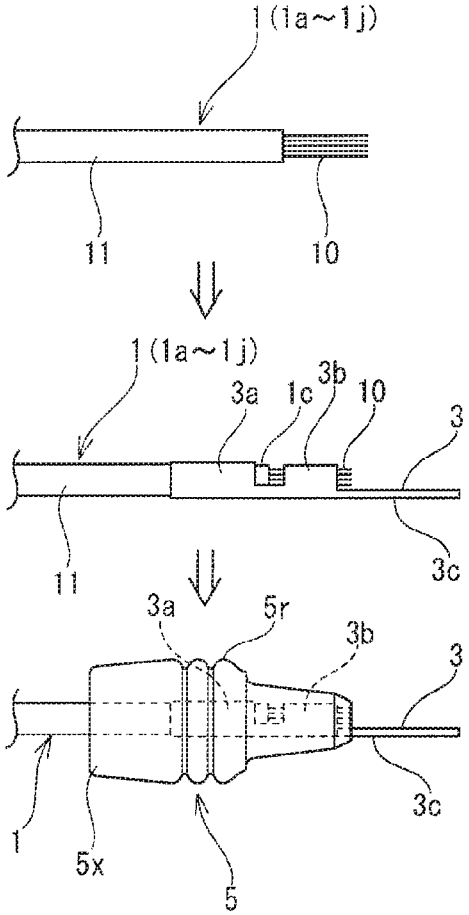

FIG. 4( A )
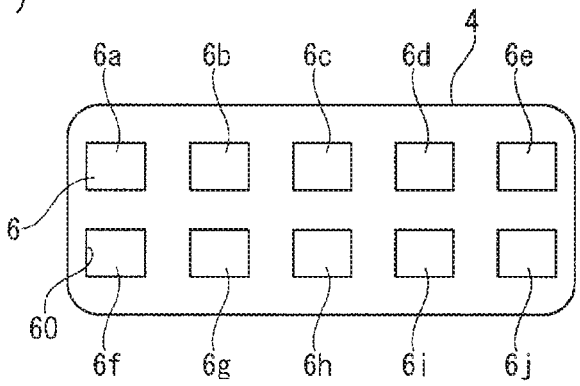
FIG. 4( B )
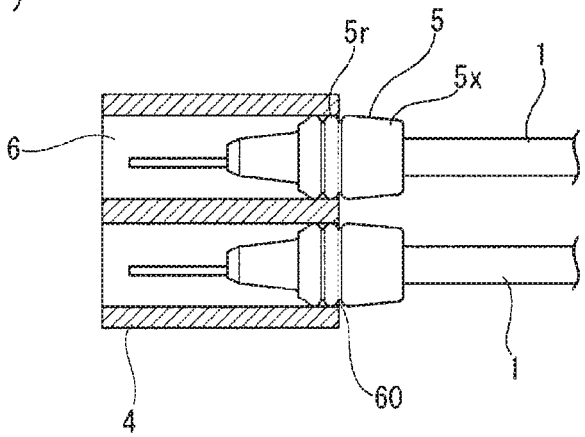
FIG. 5
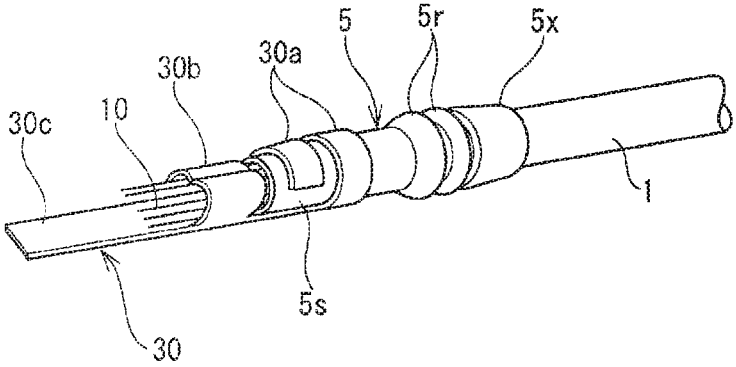

FIG. 6 ( A )
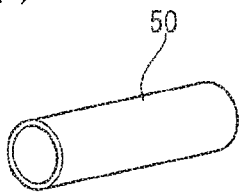
FIG. 6 ( B )
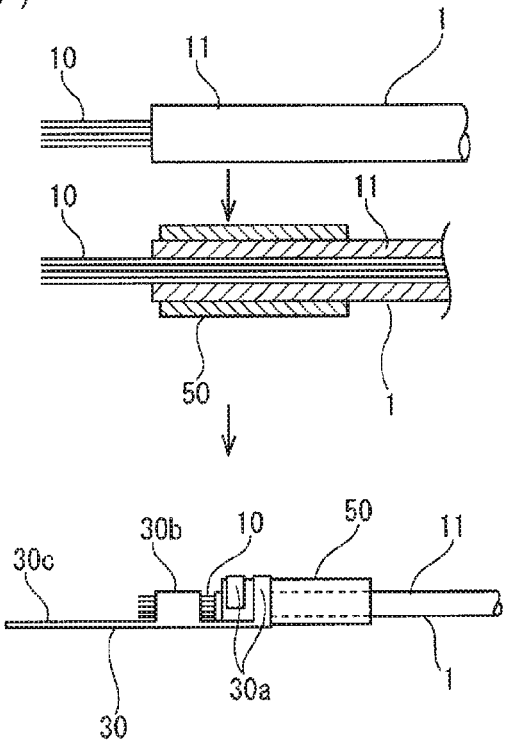
FIG. 7 ( A )
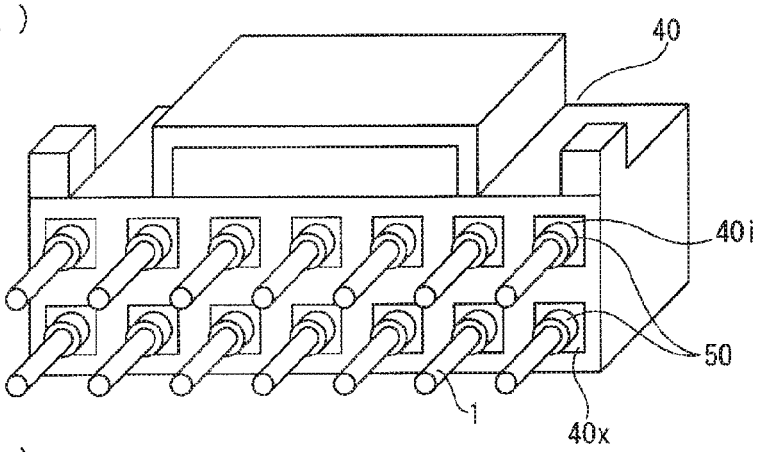
FIG. 7 ( B )
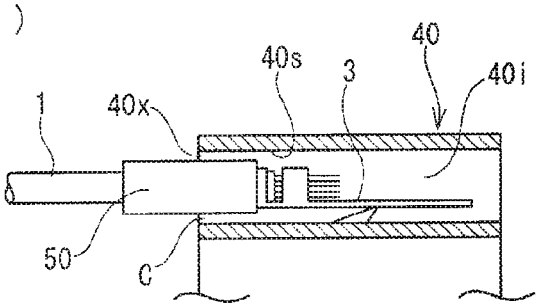

ELECTRIC WIRES WITH IDENTIFICATION INDICATORS

TECHNICAL FIELD

The present invention relates to electric wires with identification indicators, and is preferably used particularly in cases where a large number of electric wires included in a wire harness to be laid out in a vehicle are connected to a connector.

BACKGROUND ART

When a plurality of electric wires are bundled together and laid out, it is necessary to identify the respective circuits of these electric wires for the purpose of a wiring operation in which the electric wires are connected to a connector and for cases of malfunctions and maintenance during use. In order to identify these circuits, for example, the insulating coatings that cover the core wires of the electric wires may be colored.

In particular, wire harnesses to be laid out in automobiles are fabricated by bundling together a large number of electric wires, and as the number of circuits and the size of a connector increase, it is necessary to identify the circuits of an ever larger number of electric wires. Therefore, a large number of colors are used for electric wires, and some electric wires have patterns of stripes, dots, and the like that have colors that are different from that of a ground color (base color), which is a single color, thus causing a problem in that it is expensive to manufacture and manage a large number of types of electric wires.

In order to solve the foregoing problem, e.g. in Japanese Patent No. JP 4644977, the applicant provides electric wires for an automobile, where 13 colors at most are used for the electric wires included in a wire harness, and there are electric wires that have only a single ground color out of the 13 colors as well as electric wires having striped patterns having colors different from the ground color. It should be noted that nowadays, the above-mentioned 13 colors are used as a standard for the number of colors widely used for electric wires for a vehicle.

CITATION LIST

Patent Document

Patent Document 1: Japanese Patent No. 4644977

SUMMARY OF INVENTION

Technical Problem

Even if the number of colors for electric wires are reduced to 13 at most as mentioned above, when electric wires that differ in ground color are connected to a single connector, the external appearance may deteriorate. Therefore, there are cases where black sheets are wound around the plurality of electric wires that are to be laid out at conspicuous positions and differ in color, so that their external appearance is only black to make the colors of the electric wires inconspicuous. Accordingly, a problem arises in that this operation is troublesome.

Moreover, even if the number of colors for electric wires is set to 13 at most, if the number of types of electric wires that have the same size and consist of different ground colors is 13 at most, and when electric wires having striped patterns in colors different from the ground color are included, the number of types of electric wires is up to 156. Such types of electric wires that differ in hue are needed for each size of electric wire, and therefore, it is necessary to manufacture and store a vast number of electric wires of different colors. Accordingly, a further reduction in the number of colors for electric wires has been desired.

The present invention was achieved in light of the foregoing problems, and enables the electric wires for each circuit to be identified without varying the colors of the electric wires.

Solution to Problem

In order to solve the foregoing problems, the present invention provides electric wires with identification indicators, the electric wires being included in a wire harness to be laid out in an automobile, insulating coatings of the electric wires to be inserted into and locked to a plurality of terminal accommodating chambers of a single connector to be connected to the wire harness having not different colors for circuit identification but a single color, rubber plugs being attached to boundary portions that extend from crimp terminals for connection to a connector that is connected to an end of the electric wires to the insulating coatings of the electric wires by crimping the rubber plugs at insulating coating barrels of the crimp terminals, the rubber plugs having different colors for circuit identification, rear portions of the rubber plugs projecting outward from insertion opening of terminal accommodating chambers of the connector in a state in which the electric wires are connected to the connector, circuits of the electric wires being identifiable by the colors of the rubber plugs.

It should be noted that although the electric wires to be connected to a single connector all have a single color, special-purpose electric wires (e.g., high-voltage electrical wires, electric wires for an air bag circuit, and the like) whose colors are prescribed by law and product standards may be colored in colors different from those of the other electric wires.

Moreover, although there are cases where the colors of the insulating coatings of the electric wires are slightly different due to a difference in materials for forming the insulating coatings, the insulating coatings to which the rubber plugs of different hues are attached basically have a single color such as black or gray.

In the present invention, the ground color of all of the electric wires to be connected to a single connector is black, for example, and rubber plugs of different colors are attached to the electric wires. The rubber plugs are attached to the electric wires before the electric wires are connected to the connector, and the circuits of the electric wires can be identified (differentiated) by the attached rubber plugs. Therefore, when these electric wires are connected to a single connector, the electric wires configured to be used in predetermined circuits by attaching rubber plugs of predetermined colors thereto can be inserted into and locked to predetermined terminal accommodating chambers in the connector, and thus connection errors can be prevented. Moreover, when a malfunction occurs during use, the circuits can be identified by the colors of the rubber plugs attached to the electric wires, and thus it is easy to find the cause of the malfunction and repair the malfunction.

The rubber plugs having different colors may be molded using rubber compositions obtained by blending different pigments with an elastomer or rubber serving as a material for molding the rubber plugs, or may be formed by applying paints of different colors to molded rubber plugs of the same color.

If a plurality of electric wires to be connected to a single connector have a single color and rubber plugs of different colors that serve as identification indicators for the circuits of the electric wires are attached to the electric wires as mentioned above, the number of colors for electric wires for an automobile can be significantly reduced. For example, the number of ground colors can be reduced to about 1 or more and 5 or less, and the electric wires can be configured such that they have only their ground color without stripes.

Specifically, the electric wires, which are to be used in an automobile, are configured such that they each have a single ground color and no stripes, the number of different ground colors is set to less than 13, and rubber plugs of different colors are attached to the electric wires.

Nowadays, 13 colors at most are used as a standard for the number of colors for electric wires for an automobile. However, with the above configuration, if the number of hues for the rubber plugs is set to 13 at most, 13 types of rubber plugs of different hues are produced, and the rubber plugs of different colors serving as identification indicators for circuits are attached to electric wires of the same color, then the same function as the function provided by electric wires with 13 different hues can be obtained.

As mentioned above, in a state in which insulating coating barrels of crimp terminals for connection to the connector are crimped to the electric wires, and the electric wires are connected to the connector, rear portions of the rubber plugs project outward from insertion openings of terminal accommodating chambers of the connector.

If the insulating coating barrel of the crimp terminal for connection to a connector at the end of the electric wire is crimped to and attached to the rubber plug covering the insulating coating as mentioned above, the fixation of the rubber plug to the electric wire and the terminal crimping operation can be performed at the same time.

The rubber plugs are waterproofing rubber plugs that are attached to ends of the electric wires to be connected to a waterproof connector, and annular projecting portions provided on the rubber plug are brought into intimate contact with an inner circumferential surface of terminal accommodating chambers of the waterproof connector. Conventionally, an electric wire with a waterproofing rubber plug is connected to a waterproof connector to be connected to a wire harness for an automobile. Therefore, it is sufficient if waterproofing rubber plugs having a plurality of colors are provided as the waterproofing rubber plugs.

The waterproofing rubber plug comes into intimate contact with and is attached to a range extending from the crimped portion to which the insulating coating barrel of a terminal for connection to a connector is crimped to the outer circumferential surface of the insulating coating of the electric wire at the end of the electric wire, and comes into intimate contact with the inner surface of the terminal accommodating chamber of the waterproof connector, preventing the infiltration of water from outside in a state in which the waterproof rubber plug is inserted into the terminal accommodating chamber through an electric wire insertion opening.

That is, conventionally, a rubber plug is attached to an electric wire to be connected to a waterproof connector, and therefore, it is sufficient if colored rubber plug are used as the rubber plugs. This does not lead to an increase in the number of components and attaching operations, and can be easily carried out.

It is preferable to attach the colored rubber plugs to not only electric wires to be connected to a waterproof connector but also to electric wires to be connected to a non-waterproof connector.

In this case, the rubber plugs are attached to ends of the electric wires connected to a non-waterproof connector and used as circuit identification indicators, the rubber plugs are formed into a thin cylindrical tube shape, and the rubber plugs are arranged such that a gap is formed between the rubber plugs and an inner circumferential surface of terminal accommodating chambers of the non-waterproof connector.

If rubber plugs serving as circuit identification indicators are attached to a non-waterproof connector, the number of colors for all the electric wires to be laid out in an automobile can be significantly reduced.

Advantageous Effects of the Invention

By varying the colors of the rubber plugs to be attached to a plurality of electric wires to be connected to a waterproof connector and a non-waterproof connector, even when all the electric wires have a single color, the circuits of the electric wires can be identified by the rubber plugs. As a result, the number of colors for electric wires can be reduced, and a plurality of electric wires to be connected to a single connector can have a single color, for example. Therefore, there is an advantage in that the operation of covering a large number of electric wires with sheets in order to conceal their colors, and the like can be made unnecessary.

BRIEF DESCRIPTION OF DRAWINGS

FIGS. 1(A) and 1(B) show a first embodiment of the present invention. FIG. 1(A) is a perspective view showing a state in which electric wires are connected to a waterproof connector, and FIG. 1(B) is an enlarged perspective view of main portions.

FIGS. 2(A) and 2(B) show a waterproofing rubber plug. FIG. 2(A) is a cross-sectional view, and FIG. 2(B) is a front view.

FIG. 3 is a diagram showing a procedure of connecting a terminal to an electric wire and attaching a waterproofing rubber plug.

FIG. 4(A) is a schematic side view of a waterproof connector, and FIG. 4(B) is a cross-sectional view showing a state in which the ends of electric wires are inserted into the waterproof connector.

FIG. 5 is a perspective view of a modified example of the first embodiment.

FIGS. 6(A) and 6(B) show a second embodiment. FIG. 6(A) is perspective view of a rubber plug, and FIG. 6(B) is a schematic diagram showing a process of attaching the rubber plug to an electric wire and crimping a terminal to the electric wire.

FIG. 7(A) is a perspective view showing a state in which electric wires to which rubber plugs are attached are connected to a non-waterproof connector, and FIG. 7(B) is a cross-sectional view of main portions in FIG. 7(A).

DESCRIPTION OF EMBODIMENTS

Hereinafter, an embodiment of the present invention will be described with reference to FIG. 1(A) to FIG. 4(B).

A plurality of electric wires 1 of the embodiment shown in FIG. 1(A) are included in a wire harness 2 to be laid out in an automobile. A terminal 3 for connection to a connector is crimped to and connected to an end of each electric wire 1 as shown in FIG. 3, and the terminal 3 is inserted into and locked to a waterproof connector 4 shown in FIG. 4(A). Since the waterproof connector is arranged in a water infiltration region in an engine room or the like of an automobile, the infiltration of water into terminal accommodating chambers of the connector is reliably prevented.

In the waterproof connector 4, the terminal accommodating chambers are arranged in two rows in a vertical direction, and five terminal accommodating chambers are included in each row. Thus, the waterproof connector 4 includes ten terminal accommodating chambers 6 (6*a* to 6*j*) in total. The terminals 3 crimped to and connected to the ends of ten electric wires 1 (1*a*, 1*b* to 1*j*) are inserted into and locked to the ten terminal accommodating chambers 6*a* to 6*j*.

The ten electric wires, namely the electric wires 1*a* to 1*j*, are connected to different circuits. Each of the electric wires 1 is inserted into and locked to a specific terminal accommodating chamber of the terminal accommodating chambers 6*a* to 6*j*. In this embodiment, the electric wires 1*a*, 1*b* to 1*j* are inserted into and locked to the terminal accommodating chambers 6*a*, 6*b* to 6*j*, respectively.

As shown in FIG. 3, each of the ten electric wires 1 is a round electric wire obtained by covering core wires 10 with an insulating coating 11, and the insulating coatings 11 of the ten electric wires 1 all have the same color, namely black. That is, the ground color of all the electric wires 1*a* to 1*j* is black. It should be noted that the ten electric wires 1 all have the same size in this embodiment, but even if they differ in size, the ten electric wires 1 all have the same color, namely black.

In order to insert the electric wires 1 into the waterproof connector 4, a waterproofing rubber plug 5 as shown in FIG. 2(A) is attached to a boundary portion between the terminal 3 and the electric wire in each of the ten electric wires 1. Specifically, as shown in FIG. 3, the waterproofing rubber plug 5 is fitted over a range extending from a crimped portion to which a core wire barrel 3*b* and an insulating coating barrel 3*a* of the terminal 3 are crimped to the outer circumferential surface of the insulating coating 11 of the electric wire that is continuous with the insulating coating barrel 3*a*. The waterproofing rubber plug 5 is made of a rubber composition obtained by blending a pigment with a rubber or elastomer. The waterproofing rubber plug 5 is colored in a desired color depending on the blended pigment, and the ten waterproofing rubber plugs 5*a* to 5*j* that are to be attached to the ten electric wires of the same color all have different colors.

As shown in FIG. 3, the core wire barrel 3*b* of the terminal 3 is crimped to the core wires 10 exposed at an end of the electric wire 1, and the insulating coating barrel 3*a* is crimped to the insulating coating 11. The waterproofing rubber plug 5 has a substantially cylindrical tube shape, comes into intimate contact with a range extending from the electric wire connection side of a portion to which the insulating coating barrel 3*a* of the terminal 3 is crimped to a position of the insulating coating 11 near a stripped end 1*c* of the electric wire 1, and is fitted thereon and fixed thereto. An electrical contact portion 3*c* of the terminal 3 projects toward the front side with respect to the waterproofing rubber plug 5. As shown in FIG. 4(B), the waterproofing rubber plug 5 is configured to have a size with which, in a state in which the terminal 3 is inserted into the terminal accommodating chamber 6 of the waterproof connector, a sealing rib 5*r*, which is an annular projecting portion provided on the outer circumferential surface of the rubber plug 5 at the center in the longitudinal direction, can be brought into intimate contact with the inner surface at the circumferential edge of an electric wire insertion opening 60 of the terminal accommodating chamber 6, preventing the infiltration of water. In addition, the waterproofing rubber plug 5 is configured such that an end portion 5*x* of the waterproofing rubber plug 5, which is fitted on the insulating coating 11 of the electric wire 1, on the electric wire side in the longitudinal direction projects outward from the electric wire insertion opening 60 in a state in which the terminal 3 is inserted into and locked to the waterproof connector 4.

As mentioned above, the waterproofing rubber plugs 5 are attached to the ten electric wires 1*a* to 1*j*, and include the ten waterproofing rubber plugs 5*a* to 5*j* of different colors. The waterproofing rubber plugs 5*a* to 5*j* are made of rubber compositions in which pigments of different colors are blended, and they all have different ground colors.

Next, a method for forming an electric wire and a method for attaching an electric wire to a connector will be described.

First, as shown in FIG. 3, the core wires 10 are exposed by stripping the insulating coating 11 at an end of the electric wire 1, and the core wire barrel 3*b* and the insulating coating barrel 3*a* of the terminal 3 are crimped to and connected to the electric wire 1.

For the purposes of waterproofing and identification indication, waterproofing rubber plugs 5*a* to 5*j* of different colors are fitted on and fixed to the boundary portions between the electric wires and the terminals 3, and thus attached to those of the ten electric wires 1*a* to 1*j* of the electric wires 1 that are to be connected to the waterproof connector 4. In FIG. 1(B), the variety of the colors of the waterproofing rubber plugs 5*a* to 5*j* is shown by various patterns, such as oblique lines, dots, etc.

Next, the ten electric wires 1 to which the waterproofing rubber plugs 5 have been attached are connected to the waterproof connector 4. An operator manually performs this connection operation in accordance with an instruction manual (not shown) that indicates the correspondence between the colors of the waterproofing rubber plugs 5 and the positions of the terminal accommodating chambers 6 of the waterproof connector 4.

For example, the red rubber plug 5*a* is attached to the electric wire 1*a* for circuit A, and the blue rubber plug 5*b* is attached to the electric wire 1*b* for circuit B. Based on the color of the rubber plug 5*a*, the red rubber plug 5*a* and the blue rubber plug 5*b* are respectively inserted into and locked to the terminal accommodating chamber 6*a* and the terminal accommodating chamber 6*b* of the ten terminal accommodating chambers 6*a* to 6*j* of the waterproof connector 4 in accordance with the instruction manual.

As described above, the electric wires 1*a* to 1*j* are inserted into and connected to the corresponding terminal accommodating chambers 6*a* to 6*j* depending on the colors of the rubber plugs 5*a* to 5*j*, which are attached to the electric wires 1*a* to 1*j*, in accordance with the instruction manual, thus making it possible to reliably prevent a misconnection of the electric wires 1*a* to 1*j* to the waterproof connector 4.

Each terminal 3 inserted into the terminal accommodating chamber 6 of the waterproof connector 4 is positioned and held by a locking piece (not shown) that projects from the inner surface of the terminal accommodating chamber 6 being locked to a locking step portion (not shown) of the terminal 3. In this state, the sealing rib 5*r* of the waterproofing rubber plug 5 comes into intimate contact with the inner surface at the circumferential edge of the electric wire insertion opening 60, and the end portion 5*x* of the waterproofing rubber plug 5 projects outward from the electric wire insertion opening 60.

As described above, in a state in which the electric wire 1 is connected to the waterproof connector 4, the color of the end portion 5*b* of the waterproofing rubber plug 5 projecting outward from the electric wire insertion opening 60 can be checked, and thus the circuits of the electric wires 1 inserted into the terminal accommodating chambers 6*a* to 6*j* can be identified by checking the colors of the end portions 5*x* of the waterproofing rubber plugs 5. As a result, in cases of maintenance and malfunctions, the circuits of the electric wires 1 can be identified (differentiated) by the colors of the waterproofing rubber plugs 5 by checking the electric wire insertion openings 60 of the waterproof connector 4 in detail.

On the other hand, since the end portions 5*x* of the waterproofing rubber plugs 5 project only slightly outward from the electric wire insertion openings 60 of the waterproof connector 4 and are inconspicuous, an external appearance is given in which black electric wires 1 are connected to the waterproof connector 4. Therefore, there is no need to cover the electric wires with black sheets or the like, unlike in the case where conventional multicolored electric wires are used.

FIG. 5 shows a modified example of a first embodiment.

In the modified example, an insulating coating barrel 30*a* of a crimp terminal 30 is crimped to and fixed to a small-diameter portion 5*s* that is obtained by making a portion to the front of the waterproofing rubber plug 5 thin. It should be noted that in the drawings, 30*b* denotes a core wire barrel, and 30*c* denotes an electrical contact portion.

The other structures and effects are the same as those of the first embodiment, and thus their description will be omitted.

FIGS. 6(A)-7(B) show a second embodiment.

In the second embodiment, a plurality of (fourteen) electric wires 1 have a single color, namely black, and these electric wires 1 are inserted into and locked to a multi-contact non-waterproof connector 40 (having terminal accommodating chambers arranged in two rows in the vertical direction and in seven columns in each row). As in the first embodiment, rubber plugs 50 that differ in ground color are fitted on the electric wires 1.

The rubber plugs 50 are not waterproofing rubber plugs, and are used as circuit identification indicators. In the same manner as the rubber plugs 5 of the first embodiment, the ground colors of the rubber plugs 50 have different colors and have no stripes, no dots, or the like.

The rubber plugs 50 differ in shape from the waterproofing rubber plugs of the first embodiment. As shown in FIG. 6(A), each rubber plug 50 has a thin-walled cylindrical tube shape that has the same cross-sectional shape along the entire front-rear direction, and is not provided with sealing ribs projecting from the outer circumferential surface.

As in the modified example shown in FIG. 5, the insulating coating barrel 30*a* of the crimp terminal 30 is crimped to the outer circumferential surface of the rubber plug 50, and the rubber plug 50 is fitted on and fixed to a range extending from a portion to which the insulating coating barrel 30*b* is crimped to the outer circumferential surface of the insulating coating 11 of the electric wire.

In a state in which the electric wire 1 to which the rubber plug 50 is attached is inserted into and locked to a terminal accommodating chamber 40*i* of the non-waterproof connector 40, a gap C is formed between an inner circumferential surface 40*s* of the terminal accommodating chamber and the outer circumferential surface of the rubber plug 50, and the rubber plug 50 does not seal the terminal accommodating chamber. Moreover, the rear portion of the rubber plug 50 is fitted on the electric wire 1 guided through an electric wire insertion opening 40*x*, thus making it possible to identify a circuit by the color of the rubber plug 50 during maintenance.

If rubber plugs of different colors serving as circuit identification indicators are attached to not only electric wires to be connected to a waterproof connector but also electric wires to be connected to a non-waterproof connector, the number of colors for all the electric wires to be laid out in an automobile can be significantly reduced. As a result, it is possible to alleviate the task of differentiating electric wires by color and to simplify component management.

REFERENCE SIGNS LIST

1 (1*a* to 1*j*) Electric wire
3 Terminal
4 Waterproof connector
5 (5*a* to 5*j*) Waterproofing rubber plug
6 (6*a* to 6*j*) Terminal accommodating chamber
60 Electric wire insertion opening
10 Core wire
11 Insulating coating
30 Crimp terminal
40 Non-waterproof connector
50 Rubber plug

The invention claimed is:

1. Electric wires with identification indicators, the electric wires being included in a wire harness to be laid out in an automobile, insulating coatings of the electric wires to be inserted into and locked to a plurality of terminal accommodating chambers of a single connector to be connected to the wire harness not having different colors for circuit identification but a single color, rubber plugs being attached to boundary portions that extend from crimp terminals for connection to a connector that is connected to an end of the electric wires to the insulating coatings of the electric wires by crimping the rubber plugs at insulating coating barrels of the crimp terminals, the rubber plugs having different colors for circuit identification, rear portions of the rubber plugs projecting outward from insertion openings of the terminal accommodating chambers of the connector in a condition in which the electric wires are connected to the connector, circuits of the electric wires being identifiable by the colors of the rubber plugs.

2. The electric wires with identification indicators according to claim 1, wherein the different colors are attained by molding the rubber plugs using rubber compositions obtained by blending different pigments with an elastomer or rubber serving as a material for molding the rubber plugs, or by applying paints of different colors to rubber plugs molded using the same material.

3. The electric wires with identification indicators according to claim 1, wherein the electric wires, which are to be used in an automobile, are configured such that they each have a single ground color and no stripes, the number of different ground colors being less than 13, and rubber plugs of different colors are attached to the electric wires.

4. The electric wires with identification indicators according to claim 1, wherein the rubber plugs are waterproofing rubber plugs that are attached to ends of the electric wires to be connected to a waterproof connector, and annular projecting portions provided on the rubber plug are brought into intimate contact with an inner circumferential surface of terminal accommodating chambers of the waterproof connector.

5. The electric wires with identification indicators according to claim 1, wherein the rubber plugs are attached to ends of the electric wires connected to a non-waterproof connector and used as circuit identification indicators, the rubber plugs are formed into a thin cylindrical tube shape, and the rubber plugs are arranged such that a gap is formed between the rubber plugs and an inner circumferential surface of terminal accommodating chambers of the non-waterproof connector.

* * * * *